US010822960B2

(12) United States Patent
Mottram et al.

(10) Patent No.: US 10,822,960 B2
(45) Date of Patent: Nov. 3, 2020

(54) TURBINE BLADE COOLING

(71) Applicant: ROLLS-ROYCE plc, London (GB)

(72) Inventors: Martin Mottram, Bristol (GB); Paul A Sellers, Leicestershire (GB)

(73) Assignee: ROLLS-ROYCE plc, London (GB)

( * ) Notice: Subject to any disclaimer, the term of this patent is extended or adjusted under 35 U.S.C. 154(b) by 186 days.

(21) Appl. No.: 15/686,737

(22) Filed: Aug. 25, 2017

(65) Prior Publication Data

US 2018/0073372 A1 Mar. 15, 2018

(30) Foreign Application Priority Data

Sep. 14, 2016 (GB) ..... 1615572.3
Sep. 14, 2016 (GB) ..... 1615573.1

(51) Int. Cl.
*F01D 5/18* (2006.01)
*F01D 5/20* (2006.01)
*F01D 5/14* (2006.01)

(52) U.S. Cl.
CPC ..... *F01D 5/187* (2013.01); *F01D 5/147* (2013.01); *F01D 5/20* (2013.01); *F05D 2220/32* (2013.01);
(Continued)

(58) Field of Classification Search
CPC ..... F01D 5/187; F01D 5/147; F01D 5/20; F01D 5/18; F01D 5/186; F05D 2220/32;
(Continued)

(56) References Cited

U.S. PATENT DOCUMENTS 3,635,585 A * 1/1972 Metzler, Jr. ..... F01D 5/20 416/96 R
4,753,575 A * 6/1988 Levengood ..... F01D 5/187 415/115

(Continued)

FOREIGN PATENT DOCUMENTS

EP 1882817 A2 1/2008
EP 2161412 A2 3/2010

(Continued)

OTHER PUBLICATIONS

Feb. 22, 2017 Search Report issued in Great Britain Patent Application No. 1615572.3.

(Continued)

*Primary Examiner* — Michael Lebentritt
*Assistant Examiner* — Eric J Zamora Alvarez
(74) *Attorney, Agent, or Firm* — Oliff PLC

(57) ABSTRACT

A blade has a root portion and elongate portion extending from the root portion to a tip. The elongate portion has an aerofoil-shaped cross section having leading and trailing edges and suction and pressure sides. The tip may include a gutter defining squealer. The squealer has a wall extending from the trailing edge and along a substantial portion of the tip perimeter. A main trailing edge cooling channel extends within the elongate portion in a direction from root to tip adjacent the trailing edge and exiting into the gutter. A gallery channel is arranged just behind the gutter and extends from an open end intersecting the main trailing edge cooling channel to a closed end located just behind a trailing edge apogee. Cooling channels extend from the gallery channel and through the squealer wall. The gallery channel diameter is greater at the open end than the closed end.

14 Claims, 5 Drawing Sheets

SIDE VIEW

(52) U.S. Cl.
CPC .. *F05D 2240/304* (2013.01); *F05D 2240/305* (2013.01); *F05D 2240/306* (2013.01); *F05D 2260/202* (2013.01)

(58) Field of Classification Search
CPC ..... F05D 2240/304; F05D 2240/305; F05D 2240/306; F05D 2260/202; Y02T 50/676; Y02T 50/673
See application file for complete search history.

(56) References Cited

U.S. PATENT DOCUMENTS 6,099,252 A * 8/2000 Manning ..... F01D 5/187 415/116
7,645,122 B1 1/2010 Liang
7,704,047 B2 * 4/2010 Liang ..... F01D 5/186 416/97 R
8,157,504 B2 * 4/2012 Amaral ..... F01D 5/20 415/115
10,107,108 B2 * 10/2018 Jones ..... F01D 5/187
2014/0083116 A1 * 3/2014 Crites ..... F01D 5/187 60/806
2014/0311164 A1 * 10/2014 Kwon ..... F01D 5/20 60/806
2015/0292335 A1 10/2015 Dawson et al.
2015/0345303 A1 12/2015 Dong et al.

FOREIGN PATENT DOCUMENTS

EP 2243930 A2 10/2010
EP 2378074 A1 10/2011
EP 2479382 A1 7/2012
EP 2949868 A1 12/2015
EP 3064714 A1 9/2016
KR 20120048439 A 5/2012

OTHER PUBLICATIONS

Oct. 26, 2016 Search Report issued in Great Britain Patent Application No. 1615573.1.
Feb. 8, 2018 European Search Report issued in European Patent Application No. 17 18 7066.

* cited by examiner

PLAN VIEW

SIDE VIEW

END VIEW

SIDE VIEW

PLAN VIEW

TURBINE BLADE COOLING

FIELD OF INVENTION

The present invention relates to shroudless turbine blades. More particularly the invention relates to the arrangement of internal cooling channels in the tip region of such blades and the geometry of the blades at their tip.

BACKGROUND TO INVENTION

In a gas turbine engine, a compressor is arranged to compress air for delivery to a combustor. The combustor mixes the compressed air with fuel and ignites the mixture. Gas products of this combustion are directed at a turbine blade assembly causing rotation of the blades and the production of power from the turbine assembly. Combustion temperatures may exceed 1400° C. and typical configurations expose the turbine blade assemblies to these high temperatures. Turbine blades are made of materials capable of withstanding such high temperatures and often contain cooling systems for prolonging the life of the blades, reducing the likelihood of failure as a result of exposure to these excessive temperatures.

A turbine blade has a root portion at one end and an elongated portion of aerofoil shaped cross section extending from the root portion. In a turbine blade assembly, the root portion is coupled to a platform—typically a radially outer surface of a circumferential wall of a rotor disc. The elongated portion extends radially outwardly and terminates in a tip. The aerofoil shaped cross section has a leading edge and a trailing edge.

Efforts are continually being made to improve efficiency in gas turbine engines. It is known that a significant factor in reducing efficiency of the turbine assembly is attributable to the leakage of the combustion gas products over the tips of the turbine blades through a small gap between the tips of the blade assembly and a surrounding circumferential housing. It is believed such losses could account for 30% or more of total losses in the turbine assembly. As well as reduced efficiency, consequences include reduced life of turbine components due to high thermal stresses in this region.

It is known to provide turbine blade tips with seals to reduce this gap. Such tip seals are referred to as squealer tips, the detail of which are typically machined into a cast of the turbine blade. A squealer tip is formed as a wall extending around a substantial portion of the aerofoil at the blade tip defining a recessed surface or "gutter" within. Cooling air which has passed through the elongate portion of the blade may be expelled into this gutter and dispersed into the main gas stream.

For aerodynamic efficiency, it is desirable to minimise the thickness of a blade at its trailing edge. However, thinner sections of blade are more susceptible to the extreme temperatures and are at risk of deformation and damage a consequence of which may be reduced engine efficiency and potential failure of the component. Thus, the trailing edge of the blade must be well cooled.

In known blades having squealer tips, a main trailing edge cooling channel is provided in the elongated portion of the blade and extends from root to tip of the blade. Multiple smaller diameter cooling channels (typically including effusion cooling channels) extend from main trailing edge channel through the squealer wall in the region of the trailing edge and through the elongate portion to the thinnest parts of the trailing edge. Typically a gallery channel is provided just beneath the gutter of the squealer and extends from the main trailing edge cooling channel towards the apogee of the trailing edge and effusion channels extend through the squealer wall to the gallery channel. The main trailing edge cooling channel is typically integrally cast into the blade. The gallery channel and effusion cooling channels are added in a subsequent machining step. The gallery channel is typically machined from the apogee of the trailing edge and its end at the apogee subsequently plugged or welded closed to encourage maximum flow to the effusion cooling channels.

An example of a prior art arrangement is shown in FIG. 1. The figure shows the tip of a blade from a plan view, pressure side view and trailing edge end view. As can be seen, the tip has an aerofoil shaped cross section with a leading edge 1, a trailing edge 2, a suction side 3 and a pressure side 4. A squealer comprises a squealer wall 5 which extends from the trailing edge 2 along the suction side 3, around leading edge 1 and along the pressure side 4 returning to the trailing edge 2. The wall defines a gutter 6. Main cooling channels extend along the elongated portion of the blade and exit into the gutter 6. The main cooling channels include a main trailing edge cooling channel 7. A gallery channel 8 is drilled into the trailing edge 2 from the apogee 9 of the trailing edge 2. A first plurality of effusion cooling channels 10 extend from the gallery channel 8 and through the squealer wall 5. As can be seen, in the region of the tip, the apogee 9 of the trailing edge 2 is flared 12 and enlarged to accommodate the drilling of the gallery channel 8. A second plurality of effusion cooling channels 11 extends from the main trailing edge cooling channel into the thinnest region of the trailing edge exiting on the pressure side 4 and suction side 3 adjacent the apogee 9 of the trailing edge 2.

The large overhang 12 of the squealer results in a larger wetted area and hence increased heat flux into the tip during engine operation. This increases the cooling requirement for this region. Other disadvantages of the arrangement include sub-optimal aerodynamic performance at the trailing edge resulting in efficiency losses and a weight penalty.

The present invention seeks to provide an improved cooling arrangement and associated tip design which contributes to the mitigation of the problems identified above.

STATEMENT OF THE INVENTION

In accordance with the present invention there is provided a blade comprising a root portion and an elongate portion extending from the root portion to a tip, the elongate portion having an aerofoil-shaped cross section having a leading edge, a trailing edge, a suction side and a pressure side, a main trailing edge cooling channel extending within the elongate portion in a direction from root to tip adjacent the trailing edge and exiting a surface at the tip, a gallery channel arranged just below the surface and extending from an open end intersecting the main trailing edge cooling channel to a closed end located just behind an apogee of the trailing edge and a plurality of film cooling channels extending from the gallery channel and through the suction side and or pressure side adjacent the tip wherein the gallery channel has a greater diameter at the open end than at the closed end.

The tip may include a squealer defining a gutter at the tip wherein the squealer comprises a wall extending from the trailing edge and along a substantial portion of the perimeter of the tip. In such an arrangement, the surface at which the main trailing edge cooling channel exits the tip is the gutter surface. Where a squealer is present, some or all of the film cooling channels may extend through the squealer wall.

Conveniently, the gallery channel may be integrally cast into the blade using an adapted core which defines both the main trailing edge cooling channel and has an extension defining the gallery channel. Since the gallery channel is cast into the blade, there is no need for an additional operation to close the end of a drilled gallery channel. Also, since the gallery channel is defined by the core, it is possible to enlarge a portion of the gallery channel adjacent the main trailing edge cooling channel. This allows more surface area of the gallery channel wall in which to provide film cooling channels. Thus there is greater flexibility in the arrangement of film cooling channels and the possibility for more film cooling channels (and hence greater cooling) than is obtainable with prior art arrangements. The arrangement further provides for weight reduction in this area versus the prior art arrangement.

The gallery channel may be provided in a shape which minimises flow restriction in the gallery channel. For example the gallery channel is conically tapered from its open end to its closed end. In more complex embodiments, the cross sectional shape of the gallery channel may be varied in a manner designed to tune coolant flow to suit cooling requirements in different regions of the blade tip and squealer. For example, the gallery channel is shaped to encourage optimum flow rates to the film cooling holes in accordance with cooling requirements at the exits of the film cooling holes. For example, to control the impact of aerodynamics in a known operational environment in which the blade is to be used, the gallery may be configured to bias cooling towards one of the suction side and pressure side.

The film cooling channels may comprise effusion cooling channels. Axes of the effusion cooling channels may be inclined to a surface of the squealer wall. The effusion cooling channels may have a varying cross section, for example the effusion cooling channels may include a fanned portion adjacent the exit to a squealer wall surface.

The squealer wall may extend around the entire perimeter of the tip. In an alternative, the squealer wall may extend from the trailing edge along the entirety of a first of the suction side and pressure side, around the leading edge and partly along a second of the suction side and pressure side leaving a gap between the trailing edge and an end of the squealer wall on the second side. In such embodiments, the main trailing edge cooling channel may include a bend just downstream of the exit such that the exit is displaced from a camber line of the blade elongated portion towards the gap.

In some embodiments the first side is the pressure side. In other embodiments the first side is the suction side. The end of the squealer wall on the second side may be curved.

The depth of the squealer wall may vary from a first depth at the leading edge to a second depth at the trailing edge. Optionally, the depth at the trailing edge may be greater than the depth at the leading edge. The width of the squealer wall may reduce from a maximum width at a first end of the squealer wall to a minimum width at a second end of the squealer wall. The squealer wall may include a locally extended portion adjacent the trailing edge on the first side, the extended portion extending in a widthwise direction with respect to the squealer wall and away from the gutter. The extended portion may accommodate the gallery channel.

The gutter may be shallower adjacent the leading edge than it is at the trailing edge. Alternatively, the gutter may be shallower at the trailing edge as compared to the leading edge. Variation in gutter depth may be achieved by providing an inclined surface to the tip within the gutter. Alternatively, variation in gutter depth is achieved by varying the height of the wall of the squealer between the trailing edge and the leading edge. Gutter depth may vary gradually along an incline, alternatively or in addition, gutter depth may vary due to one or more steps within the gutter. The gallery channel may be shaped to follow variations in the depth of the gutter. For example, the gallery channel may include a stepped section to accommodate a step in the gutter.

The blade may be configured for use in a gas turbine engine, for example the blade may be configured for use in a compressor section or turbine section of a gas turbine engine. One useful application of the design of the invention is in blades of a high pressure turbine stage in a gas turbine engine.

For the purposes of exemplification, some embodiments of the invention will now be described with reference to the accompanying Figures in which;

BRIEF DESCRIPTION OF DRAWINGS

FIG. 1 has already been described above.

DETAILED DESCRIPTION OF EMBODIMENTS

Figure 1A:
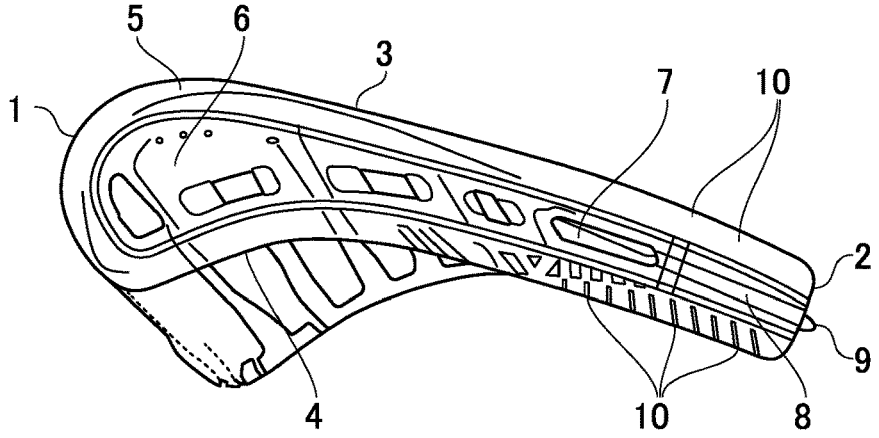
FIG. 1A PRIOR ART
FIG. 1A shows in plan view a blade tip having a squealer and cooling channel arrangement as is known from the prior art.
Figure 1B:
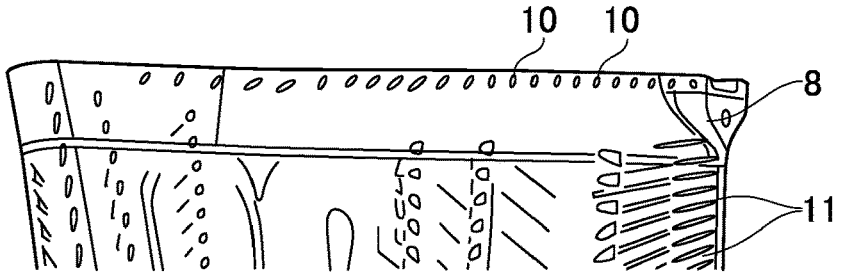
FIG. 1B PRIOR ART
FIG. 1B shows in side view a blade tip having a squealer and cooling channel arrangement as is known from the prior art.
Figure 1C:
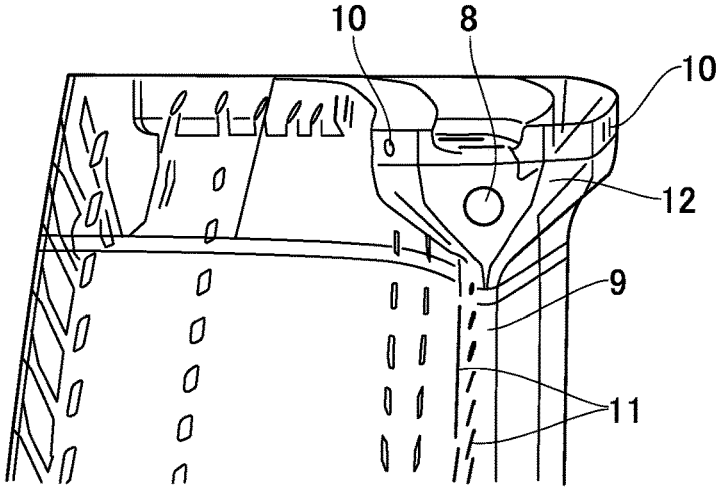
FIG. 1C PRIOR ART
FIG. 1C shows in end view a blade tip having a squealer and cooling channel arrangement as is known from the prior art.
Figure 2A:
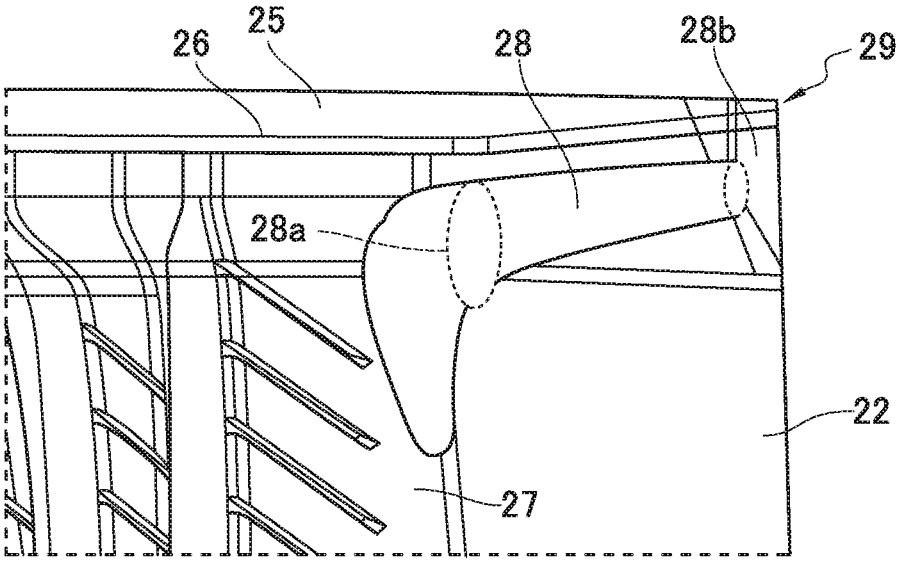
FIG. 2A shows in side view a first embodiment of a blade in accordance with the invention.
Figure 2B:
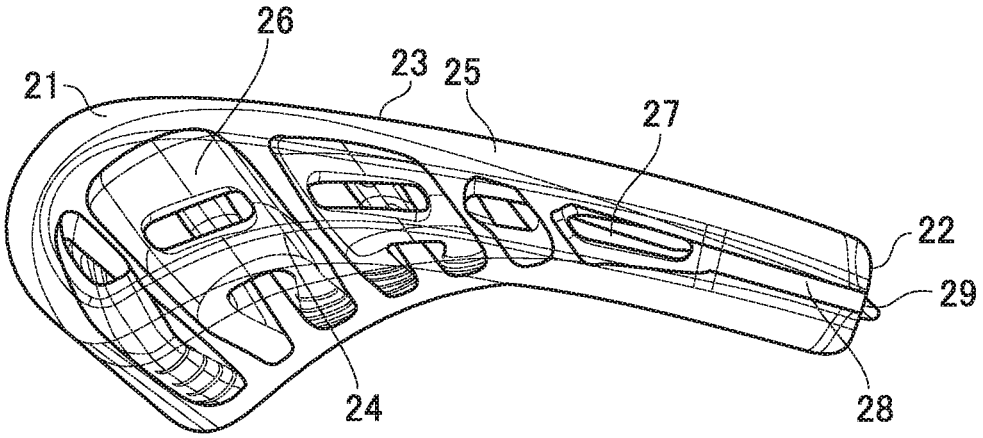
FIG. 2B shows in plan view a first embodiment of a blade in accordance with the invention.

FIG. 2 shows side and plan views of a blade tip configured in accordance with the invention. As can be seen, the tip includes a leading edge 21, a trailing edge 22, a suction side 23, a pressure side 24, and a squealer wall 25 extending around the perimeter of the tip. The squealer wall 25 bounds a gutter 26. Extending through the elongated portion of the blade in a root to tip direction is a main trailing edge cooling channel 27. The main trailing edge cooling channel 27 exits into the gutter 26. The main trailing edge cooling channel 27 is integrally cast into the blade, its shape being defined by a core positioned in a mould during casting of the blade. The core is subsequently leached out of the cast blade leaving the internal channel 27. As compared to the prior art, the core for manufacturing the illustrated embodiment is extended to include a gallery channel section which defines the gallery channel 28. The gallery channel has an open end 28*a* intersecting the main trailing edge cooling channel 27 and a closed end 28*b* which sits just behind the apogee 29 of the trailing edge 22 of the elongated section. It will be noted that the cross sectional diameter at the open end 28*a* of the gallery channel 28 is significantly larger than that of the closed end 28*b* of the gallery channel 28 and the gallery channel 28 gradually tapers from the open end 28*a* to the closed end 28*b*.

Figure 3:
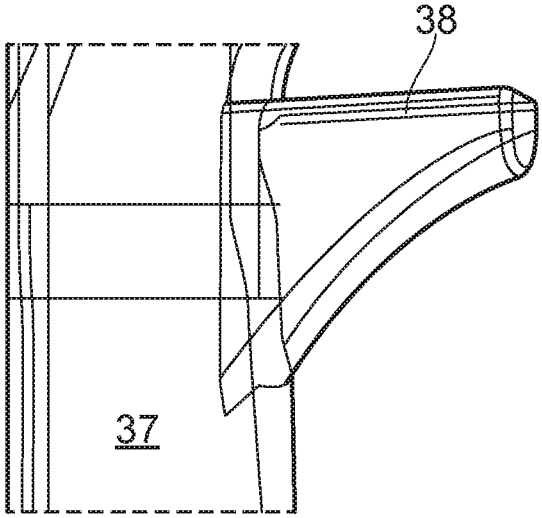
FIG. 3 shows a portion of a core for use in casting a blade in accordance with the invention.

In FIG. 3, a core for use in casting a blade in accordance with the invention comprises a first section 37 which defines the main trailing edge cooling passage which is integrally formed with a second section 38 which defines the gallery channel. As can be seen, a wall of the core of the second section 38 proximal to the tip of the core extends substantially orthogonally to the first section 37. An oppositely facing wall of the second section 38 has a smoothly curved and inclined surface resulting in a spout shaped second portion 38.

Figure 4:
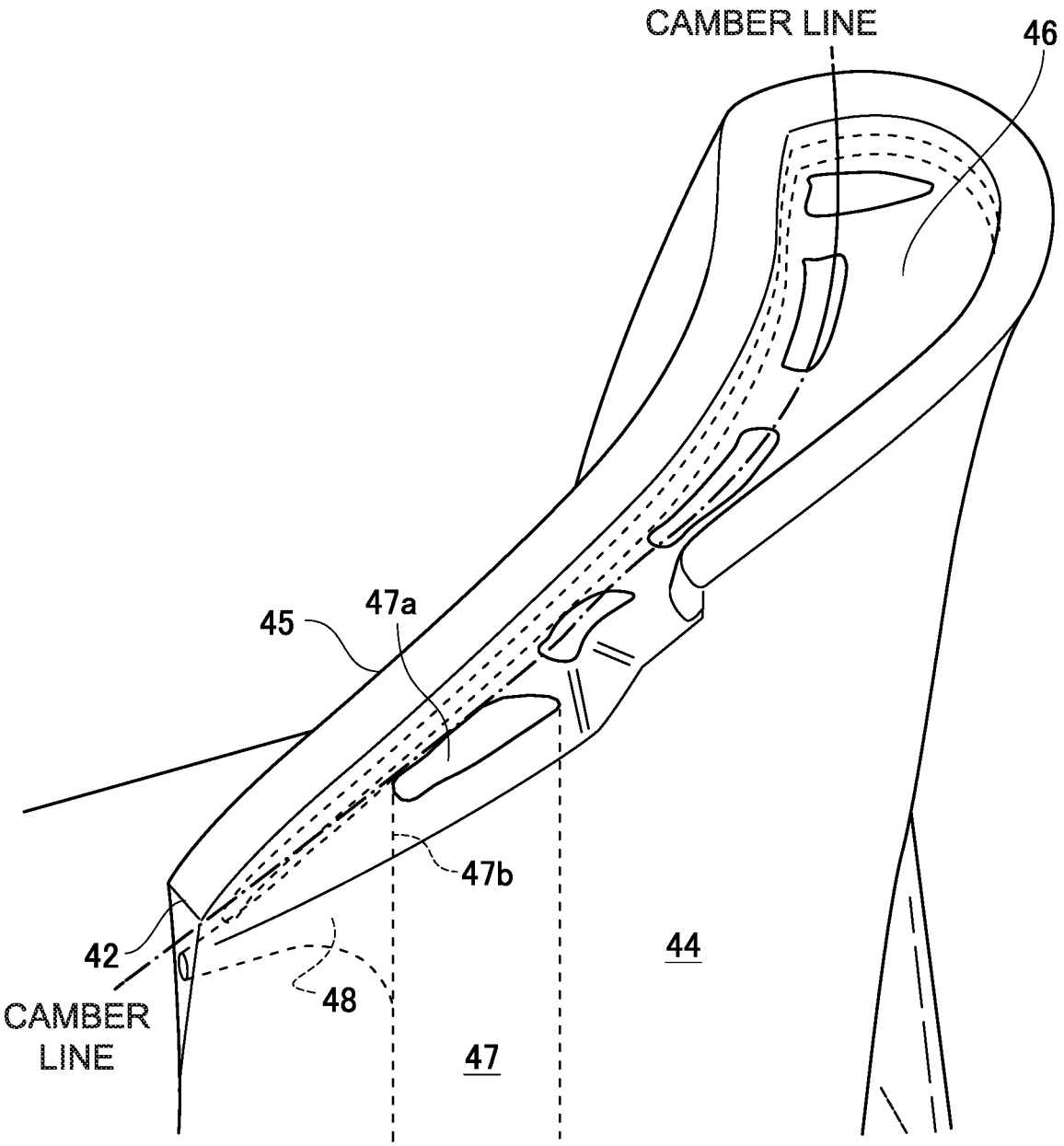
FIG. 4 shows a transparent view of a tip of a blade in accordance with an embodiment of the invention.

In FIG. 4, a blade tip has a squealer wall 45 bordering a gutter 46. In this embodiment, the squealer wall terminates midway along the suction side 44 of the aerofoil cross-section of the elongate portion of the blade leaving a gap extending from the trailing edge 42. Within the elongate portion is a main trailing edge cooling channel 47 integrally formed with a spout-shaped gallery channel 48. The main trailing edge cooling channel 47 has an exit 47*a* which emerges into the gutter 46. As can be seen, just upstream of the exit 47*a*, the main trailing edge cooling channel bends 47*b* towards the suction side 44 resulting in the exit 47*a* being positioned to a suction side 44 side of a camber line of the aerofoil cross section.

Figure 5:
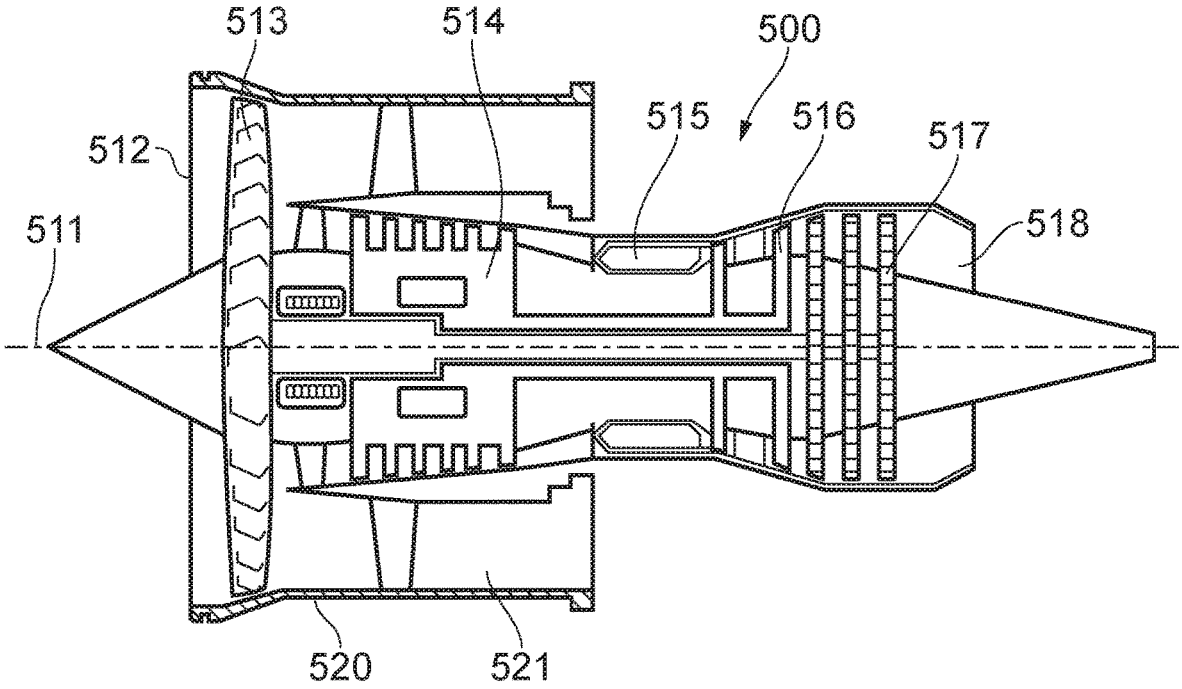
FIG. 5 shows an example of a gas turbine engine into which blades in accordance with the invention may usefully be incorporated.

FIG. 5 shows an example of a gas turbine engine into which blades in accordance with the invention may usefully be incorporated.

With reference to FIG. 5, a gas turbine engine is generally indicated at 500, having a principal and rotational axis 511. The engine 500 comprises, in axial flow series, an air intake 512, a propulsive fan 513, a high-pressure compressor 514, combustion equipment 515, a high-pressure turbine 516, a low-pressure turbine 517 and an exhaust nozzle 518. A nacelle 520 generally surrounds the engine 500 and defines the intake 512.

The gas turbine engine 500 works in the conventional manner so that air entering the intake 512 is accelerated by the fan 513 to produce two air flows: a first air flow into the high-pressure compressor 514 and a second air flow which passes through a bypass duct 521 to provide propulsive thrust. The high-pressure compressor 514 compresses the air flow directed into it before delivering that air to the combustion equipment 515.

In the combustion equipment 515 the air flow is mixed with fuel and the mixture combusted. The resultant hot combustion products then expand through, and thereby drive the high and low-pressure turbines 516, 517 before being exhausted through the nozzle 518 to provide additional propulsive thrust. The high 516 and low 517 pressure turbines drive respectively the high pressure compressor 514 and the fan 513, each by suitable interconnecting shaft.

For example the blades of the high and low pressure turbines 516, 517 may be configured in accordance with blades of the invention described herein.

Other gas turbine engines to which the present disclosure may be applied may have alternative configurations. By way of example such engines may have an alternative number of interconnecting shafts (e.g. three) and/or an alternative number of compressors and/or turbines. Further the engine may comprise a gearbox provided in the drive train from a turbine to a compressor and/or fan.

It will be understood that the invention is not limited to the embodiments above-described and various modifications and improvements can be made without departing from the concepts described herein and claimed in the appended claims. Except where mutually exclusive, any of the features may be employed separately or in combination with any other features and the disclosure extends to and includes all combinations and sub-combinations of one or more features described herein.

The invention claimed is:

1. A blade comprising:

a root portion; and an elongate portion extending from the root portion to a tip, the elongate portion having an aerofoil-shaped cross section having a leading edge, a trailing edge, a suction side and a pressure side, a main trailing edge cooling channel extending within the elongate portion in a direction from root to tip adjacent the trailing edge and exiting into a surface at the tip, a gallery channel arranged adjacent to the surface and extending from an open end intersecting the main trailing edge cooling channel to a closed end located adjacent to an apogee of the trailing edge, wherein the open end faces towards the leading edge, and the closed end faces towards the trailing edge, and the gallery channel has a greater radial cross-sectional area at the open end than at the closed end.

2. The blade as claimed in claim 1, wherein the tip includes a squealer defining a gutter at the tip, and wherein the squealer comprises a squealer wall extending from the trailing edge and along a substantial portion of a perimeter of the tip, the main trailing edge cooling channel exits the tip at the gutter.

3. The blade as claimed in claim 2, wherein the squealer wall extends around the entire perimeter of the tip.

4. The blade as claimed in claim 2, wherein the squealer wall extends from the trailing edge along an entirety of a first side of one of the suction side and the pressure side, around the leading edge and partly along a second side of the other one of the suction side and the pressure side, leaving a gap between the trailing edge and an end of the squealer wall on the second side of the suction side and pressure side.

5. The blade as claimed in claim 4, wherein the main trailing edge cooling channel includes a bend just upstream of an exit such that the exit is displaced from a camber line of the blade elongate portion towards the gap.

6. The blade as claimed in claim 2, wherein a width of the squealer wall reduces from a maximum width at a first end of the squealer wall to a minimum width at a second end of the squealer wall.

7. The blade as claimed in claim 2, wherein a depth of the squealer varies from a first depth at the leading edge to a second depth at the trailing edge.

8. The blade as claimed in claim 2, wherein the gutter is shallower adjacent the leading edge than at the trailing edge and the gallery channel is shaped to follow variations in a depth of the gutter.

9. The blade as claimed in claim 1, wherein the gallery channel is integrally cast into the blade using an adapted core which defines both the main trailing edge cooling channel and an extension defining the gallery channel.

10. The blade as claimed in claim 1, wherein the gallery channel is provided in a shape which minimizes flow restriction in the gallery channel.

11. The blade as claimed in claim 4, wherein the gallery channel is configured to bias cooling towards one of the suction side and pressure side.

12. The blade as claimed in claim 1, wherein a cross sectional shape of the gallery channel is varied in a manner designed to tune coolant flow to suit cooling requirements in different regions of the blade tip and squealer.

13. A gas turbine engine comprising:

one or more turbine blades, the one or more blades comprising:

a root portion and an elongate portion extending from the root portion to a tip, the elongate portion having an aerofoil-shaped cross section having a leading edge, a trailing edge, a suction side and a pressure side, a main trailing edge cooling channel extending within the elongate portion in a direction from root to tip adjacent the trailing edge and exiting into a surface at the tip, a gallery channel arranged adjacent to the surface and extending from an open end intersecting the main trailing edge cooling channel to a closed end located adjacent to an apogee of the trailing edge, wherein the open end faces towards the leading edge, and the closed end faces towards the trailing edge, and the gallery channel has a greater radial cross-sectional area at the open end than at the closed end.

14. The gas turbine engine as claimed in claim 13, wherein the tip of the blade includes a squealer defining a gutter at the tip, wherein the squealer comprises a wall extending from the trailing edge and along a substantial portion of a perimeter of the tip, the main trailing edge cooling channel exits the tip at the gutter.

* * * * *